US009139973B2

(12) United States Patent
Adams et al.

(10) Patent No.: US 9,139,973 B2
(45) **Date of Patent: *Sep. 22, 2015**

(54) BAG FOR RETAINING WALL

(71) Applicants: Beau Adams, Pleasureville, KY (US); Everett Waid, Jr., Fort Meyers, FL (US)

(72) Inventors: Beau Adams, Pleasureville, KY (US); Everett Waid, Jr., Fort Meyers, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/063,493

(22) Filed: Oct. 25, 2013

(65) Prior Publication Data

US 2014/0050537 A1 Feb. 20, 2014

Related U.S. Application Data

(63) Continuation of application No. 13/442,152, filed on Apr. 9, 2012, now Pat. No. 8,602,692, which is a continuation of application No. 12/590,184, filed on Nov. 4, 2009, now Pat. No. 8,235,631.

(51) Int. Cl.
*E02D 29/02* (2006.01)
*E04C 1/39* (2006.01)

(52) U.S. Cl.
CPC ..... *E02D 29/0291* (2013.01); *E02D 29/025* (2013.01); *E04C 1/395* (2013.01)

(58) Field of Classification Search
CPC ..... E02D 29/02; E02D 29/0291
USPC ..... 405/284, 286, 287, 107, 111, 114, 115, 405/116, 15, 16, 17, 18, 21, 31
See application file for complete search history.

(56) References Cited

U.S. PATENT DOCUMENTS

| | | | | |
|---|---|---|---|---|
| 2,313,363 | A * | 3/1943 | Schmitt | 405/286 |
| 3,213,628 | A | 10/1965 | Serota | |
| 4,362,433 | A | 12/1982 | Wagner | |
| 4,650,368 | A | 3/1987 | Bayer | |
| 5,040,919 | A | 8/1991 | Hendrix | |
| 5,584,599 | A | 12/1996 | Knittel | |
| 5,632,573 | A | 5/1997 | Baker | |
| 5,971,661 | A | 10/1999 | Johnson | |
| 6,012,872 | A | 1/2000 | Perry | |
| 6,022,172 | A | 2/2000 | Siyaj | |
| 6,390,154 | B1 | 5/2002 | Hall | |
| 6,491,431 | B2 | 12/2002 | Merten | |
| 6,551,025 | B2 | 4/2003 | Dery | |
| 6,679,654 | B1 | 1/2004 | Wittenberg | |
| 7,083,364 | B2 | 8/2006 | Kim | |
| 7,431,534 | B2 | 10/2008 | Harbeck | |
| 7,445,403 | B2 | 11/2008 | Williams | |
| 8,235,631 | B2 * | 8/2012 | Adams et al. | 405/284 |
| 8,602,692 | B2 * | 12/2013 | Adams et al. | 405/284 |
| 2006/0257212 | A1 | 11/2006 | Kim | |
| 2006/0291962 | A1 | 12/2006 | Ferraiolo | |
| 2007/0110522 | A1 | 5/2007 | Kim | |

* cited by examiner

*Primary Examiner* — Frederick L Lagman
(74) *Attorney, Agent, or Firm* — Stockwell & Smedley, PSC

(57) ABSTRACT

A bag for retaining structures, includes a plurality of cells aligned side-by-side in a continuous manner and configured to be filled with a filling material. Each cell of the bag includes a bottom wall, a first side wall, a second side wall, a back wall, and a front wall, the front wall being longer than the back wall. Furthermore, the first and second side walls each include a) a first corner located where the back wall connects with the bottom wall, said first corner being substantially 90 degrees; and b) a second corner located where a respective top edge of each side wall connects with the rear wall, said second corner being substantially 90 degrees.

7 Claims, 8 Drawing Sheets

BAG FOR RETAINING WALL

CROSS-REFERENCE TO RELATED APPLICATIONS

This application is a continuation of U.S. patent application Ser. No. 13/442,152, having a filing date of Apr. 9, 2012, now U.S. Pat. No. 8,602,692, which is a continuation of U.S. patent application Ser. No. 12/590,184, having a filing date of Nov. 9, 2009, now U.S. Pat. No. 8,235,631, the entire contents and disclosure of which are incorporated herein by reference.

FIELD OF THE INVENTION

The present invention relates generally to a temporary or permanent wall for retaining material, and more particularly to a bag used in erecting such a wall.

BACKGROUND

There have been a variety of methods and techniques developed in the past for building structures that retain material. Some of these structures have been temporary, while others have been intended to be permanent. For example, during times of flooding or expected flooding, temporary levees are sometimes erected using sand bags that are filled and stacked. This type of structure is very labor intensive and is temporary in nature.

There have been attempts to develop alternative methods of erecting temporary levees such as those taught in U.S. Pat. No. 6,390,154. However, the shape of the bag and method of using the bag described in that patent restricts the use of the bag to a limited number of environments and filling material.

Alternatively, it is known to build retaining walls that require preformed bricks or stones to be stacked and supported so that material is retained such as a hillside or other embankment. Erecting these types of retaining structures is expensive in both the materials and transporting them to the work site. Also, skilled installers are required for all but the simplest structures to ensure the retaining structure has the structural integrity to perform as expected.

There remains the need, therefore, for a bag and a system and method for using that bag to build a retaining structure that is flexible in the structures that can be constructed, that is flexible in the variety of material that can be used to fill the bag, that is simple to use, and can reduce the costs of building retaining structure, whether temporary or semi-permanent.

SUMMARY

The present invention relates to a bag for retaining structures, includes a plurality of cells aligned side-by-side in a continuous manner and configured to be filled with a filling material. Each cell of the bag includes a bottom wall, a first side wall, a second side wall, a back wall, and a front wall, the front wall being longer than the back wall. Furthermore, the first and second side walls each include a) a first corner located where the back wall connects with the bottom wall, said first corner being substantially 90 degrees; and b) a second corner located where a respective top edge of each side wall connects with the rear wall, said second corner being substantially 90 degrees. Embodiments of the present invention also relate retaining structures erected using such a bag.

It is understood that other embodiments of the present invention will become readily apparent to those skilled in the art from the following detailed description, wherein it is shown and described only various embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Various aspects of a bag, system and method for erecting retaining structures are illustrated by way of example, and not by way of limitation, in the accompanying drawings, wherein.

DETAILED DESCRIPTION

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

In the figures, description and in the claims, the terms "front", "back", "side", "bottom" etc. are used to simplify referring to a particular embodiment of a bag. However, one of ordinary skill will recognize that these terms are relative and that the shape of the bag and its relative dimensions remain the same when viewed from different perspectives or used in different orientations. Thus, use of these terms is not intended to limit embodiments of the present invention to bags having only a single orientation in space.

Figure 1A:
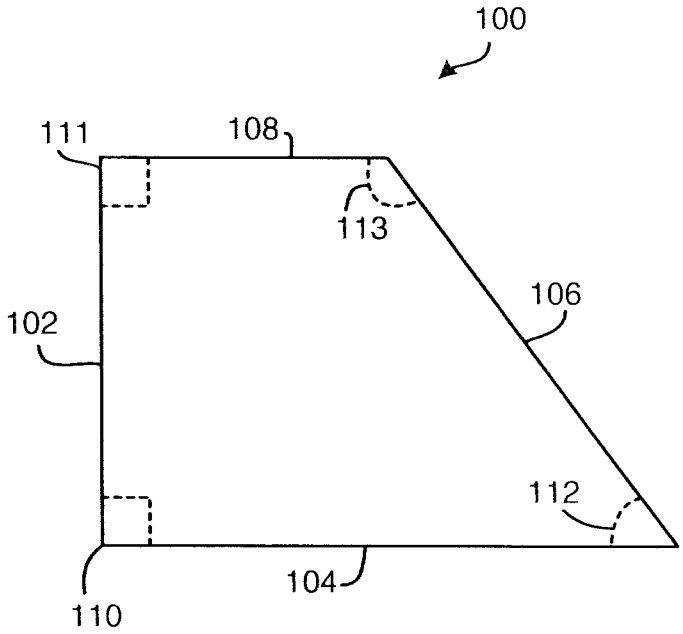
FIGS. 1A and 1B show, respectively, a side view and a top view of a portion of a bag in accordance with the principles of the present invention.
Figure 1B:
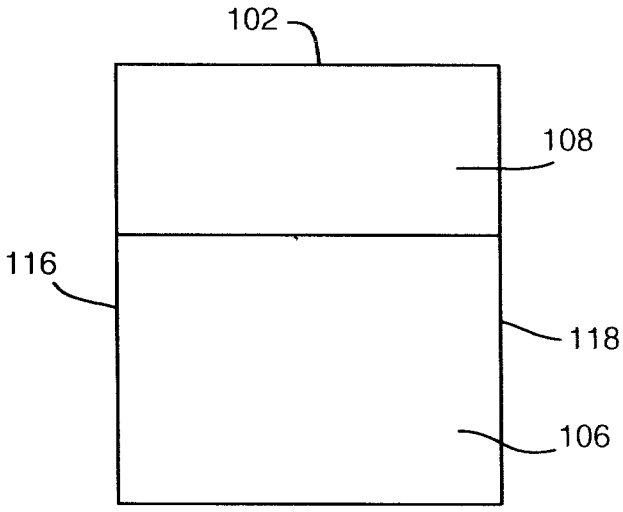

FIGS. 1A and 1B show, respectively, a side view and a top view of a portion of a bag in accordance with the principles of the present invention. In FIG. 1A a cross-sectional view of a bag 100 is depicted. There is a back wall 102, a bottom wall 104, and a front wall 106. The top 108 may include a top wall or be open. If there is a top wall present, then it may be configured in such a way that it connects with either the back wall 102 or front wall 106 to form a flap. Such a flap would be moved out of the way to allow the bag 100 to be filled and then positioned over the bag 100 once it is filled.

Of particular benefit to the bag 100 are the relative angles formed by the different walls and their respective lengths. The right angle 110 formed by the back wall 102 and bottom wall 104 adds stability and versatility to the use of the bag 100. The right angle 111 formed along the top edge of the back wall 102 also provides stability and versatility.

Making the bottom wall 104 longer than the back wall 102 provides a shape that adds stability to a structure erected using the bag 100. By making the bottom wall 104 longer than the back wall 102, the angles 112 and 113 are formed at each edge of the front wall 106 and the front wall 106 is longer than the back wall 102.

One of ordinary skill will recognize that the bag 100 of FIG. 1A may be have a variety of sizes while keeping the relative lengths and angles as discussed above. Thus, embodiments of the present invention are not limited to a particular size of bag 100. However, the use of ordinary heavy machinery to fill and move a bag 100 makes certain sizes for the bag 100 more practical than others. For example, the top opening 108 may be between one foot to two feet in length and width to accommodate typical front-end loader buckets (or specialized filling equipment). The back wall 102 may vary from about 4 feet to about 8 feet in length and a corresponding bottom wall would vary from about 7 feet to 11 feet in length. These relative dimensions and sizes are provided as examples and not as a limitation of which sizes are contemplated within the scope of the present invention.

As for material, the bag 100 can be constructed from polypropylene or similar material that can withstand the elements of a harsh environment. In particular, the material can be a weaved material with the weave spacing and thickness selected based on such things as the type of fill material being used to fill the bag, and the degree to which the bag is intended to retain fluid such as water. In addition, the bag may be coated with a water-proof seal if it is intended to be substantially impervious to water flow. One of ordinary skill will recognize that the specific material of the bag can be selected so as to be suitable for the intended application of use. A material can be selected that is woven or unwoven, impervious to fluid or porous, rugged or biodegradeable without departing from the intended scope of the present invention.

The fill material contemplated within the bag 100 includes sand, sand mixed with stones, cement or concrete, and crushed rock of various sizes. Alternatively recycled materials from tires and plastics may also be used that can be condensed to form a solid filling material.

In addition to the back wall 102 and side wall 106, already discussed, the view of FIG. 1B also shows a first side wall 116 and a second side wall 118. The fill material will be delivered to inside the bag 100 through the top opening 108.

Figure 2A:
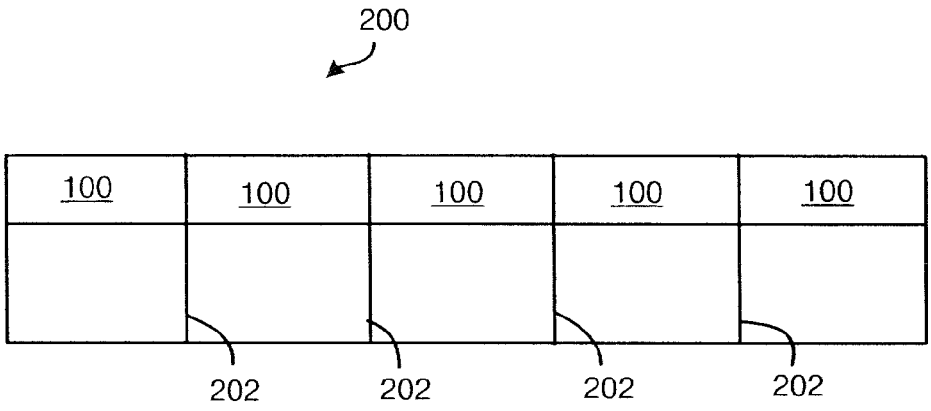
FIG. 2A shows a top view of a portion of a bag in accordance with the principles of the present invention.

FIG. 2A shows a top view of a portion of a bag in accordance with the principles of the present invention. The bag 200 of FIG. 2A shows that adjacent bags 100 are aligned to extend along a first direction. Thus, the bags 100 discussed above can more properly be referred to as bag cells 100 such that a bag 200 is comprised of a plurality of bag cells 100 adjacent to one another. In this arrangement, there is a side wall 202 that is shared by adjacent cells 100. Thus referring to FIG. 1B and FIG. 2A, the shared wall 202 would correspond to the second side wall 118 of one bag cell 100 and also correspond to the first side wall 116 of an adjacent bag cell 100. Each such shared wall 202 will have a cross-section that resembles that depicted in FIG. 1A.

Figure 2B:
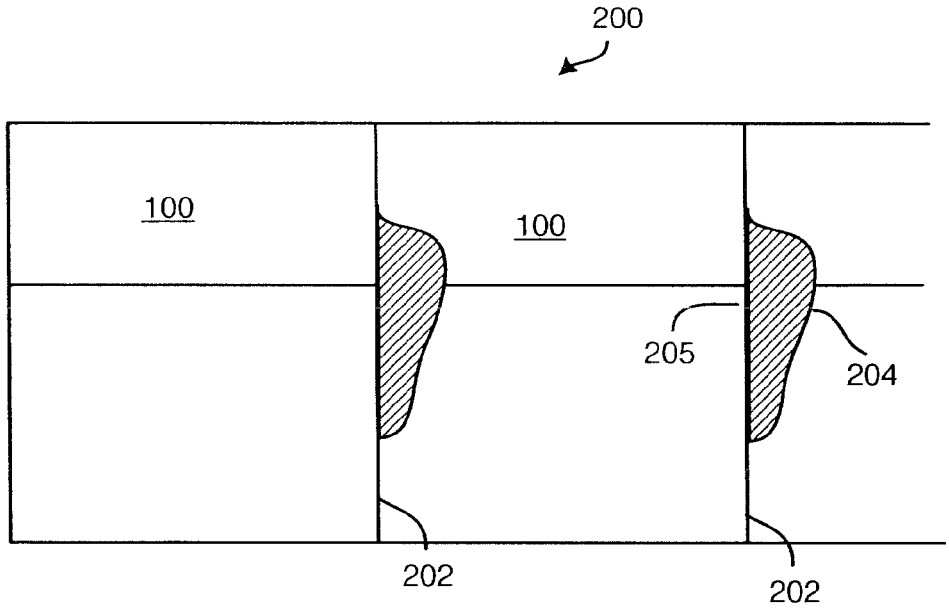
FIG. 2B shows a side-wall deformation of the bag of FIG. 2A in accordance with the principles of the present invention.

FIG. 2B shows a side-wall deformation of the bag of FIG. 2A in accordance with the principles of the present invention. Two adjacent shared walls 202 are shown in the view. In particular, each shared wall is constructed of a material (such as those described above) that is flexible enough to bow out in its center but rigid enough to substantially retain its shape along its edges.

For example, when cells 100 are filled with fill material, the top edge 205 (and the bottom edge, not shown) of the shared wall 202 substantially retain their shape but the material of the shared wall 202 stretches or bulges to create the bump 204. While selecting a material rigid enough to prevent this bump 204 can be accomplished, the bump 204 has benefits. For example, the bump 204 extends into the adjacent bag cell and tends to tie the whole structure together rather than allowing adjacent cells to slip or slide with respect to one another.

Figure 2C:
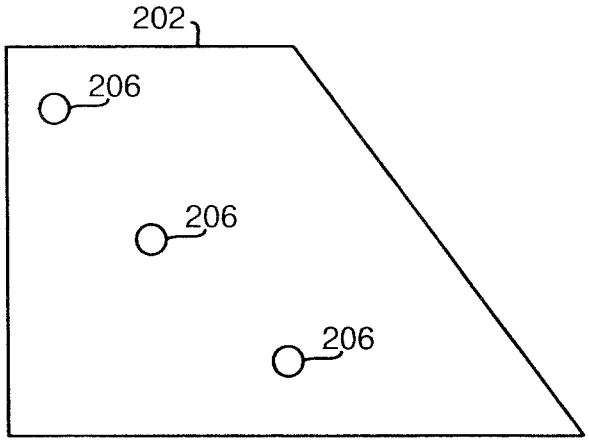
FIGS. 2C and 2D show alternative side-wall embodiments of the bag of FIG. 2A in accordance with the principles of the present invention.
Figure 2D:
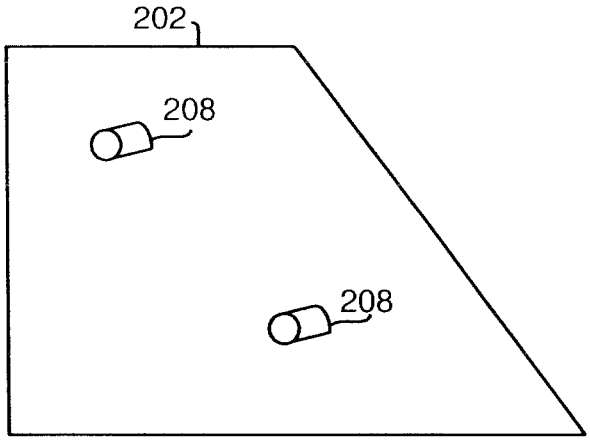

FIGS. 2C and 2D show alternative side-wall embodiments of the bag of FIG. 2A in accordance with the principles of the present invention. In FIG. 2C, one or more holes 206 are present in the shared wall 202, these holes allow filling material in one bag cell to contact with filling material in an adjacent bag cell. In one particular example, if the filling material is cement or concrete, then the holes will allow adjacent cells to tie into one another.

In FIG. 2D, there are one or more protrusions 208 in the shared wall 202. These protrusions can be located on one side or both sides of the shared wall 202.

Figure 3:
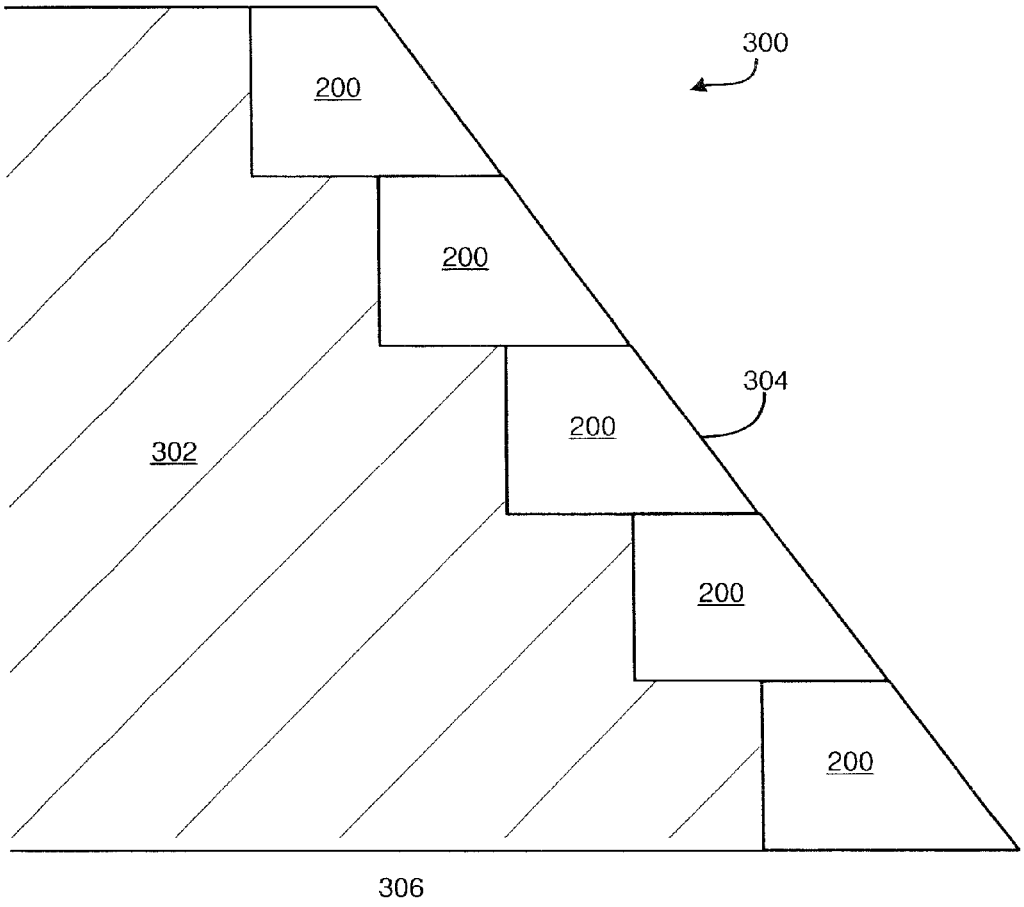
FIG. 3 shows a retaining structure erected using the bag of FIG. 2A in accordance with the principles of the present invention.

FIG. 3 shows a retaining structure erected using the bag of FIG. 2A in accordance with the principles of the present invention. The bags 200 extending in a direction perpendicular to the plane of the sheet of paper. A firm foundation 306 is provided for a first bag 200 and then additional bags 200 are stacked on top of a bag underneath. The material to be retained 302 is thus retained by the stack of bags 200. In particular, a structure can be erected such that the slope of the face 304 of the retaining structure 300 slopes at an angle that is the substantially similar to the angle 112 shown in FIG. 1A. Thus, by selecting the appropriate lengths and dimensions for the bag cells 100, a retaining structure 300 having a desired sloping face can be easily constructed.

Although not depicted in FIG. 3, the bottom walls of the cells in the bags 200 can also be allowed to bulge slightly so that they tie into the bag 200 underneath. This feature provides additional strength and stability to the retaining structure 300. In constructing the structure 300, the bags 200 can be filled to different lengths. For example, the bags 200 may be collapsible like an accordion so that pulling (in the direction that the bag extends) on a plurality of folded-up cells will expose and open one cell. This cell can be filled and then the pulling continues to expose and open the next, adjacent cell for filling. If an entire bag 200 is not used when a desired wall length is reached, then the unused cells may be cut away. If, however, additional bags 200 are needed to achieve a desired length, then a bag can be attached to the last cell of a first bag and the pulling, opening, and filling steps continue with the second bag.

Figure 4A:
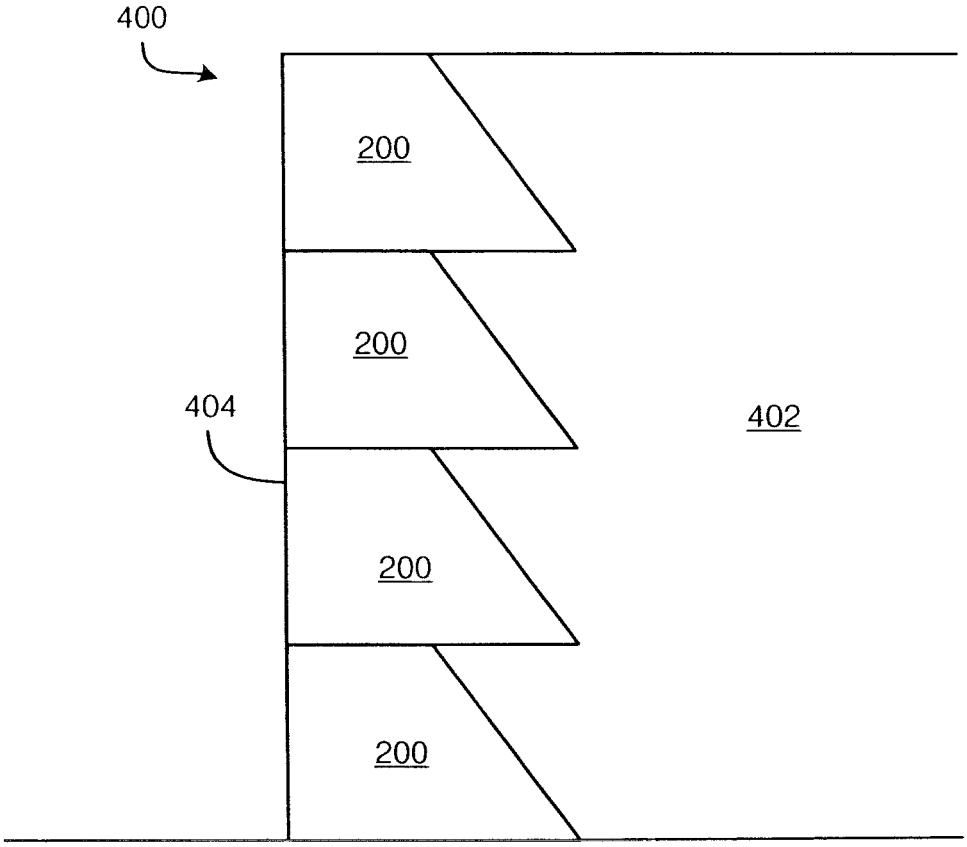
FIGS. 4A and 4B show alternative retaining structures erected using the bag of FIG. 2A in accordance with the principles of the present invention.
Figure 4B:
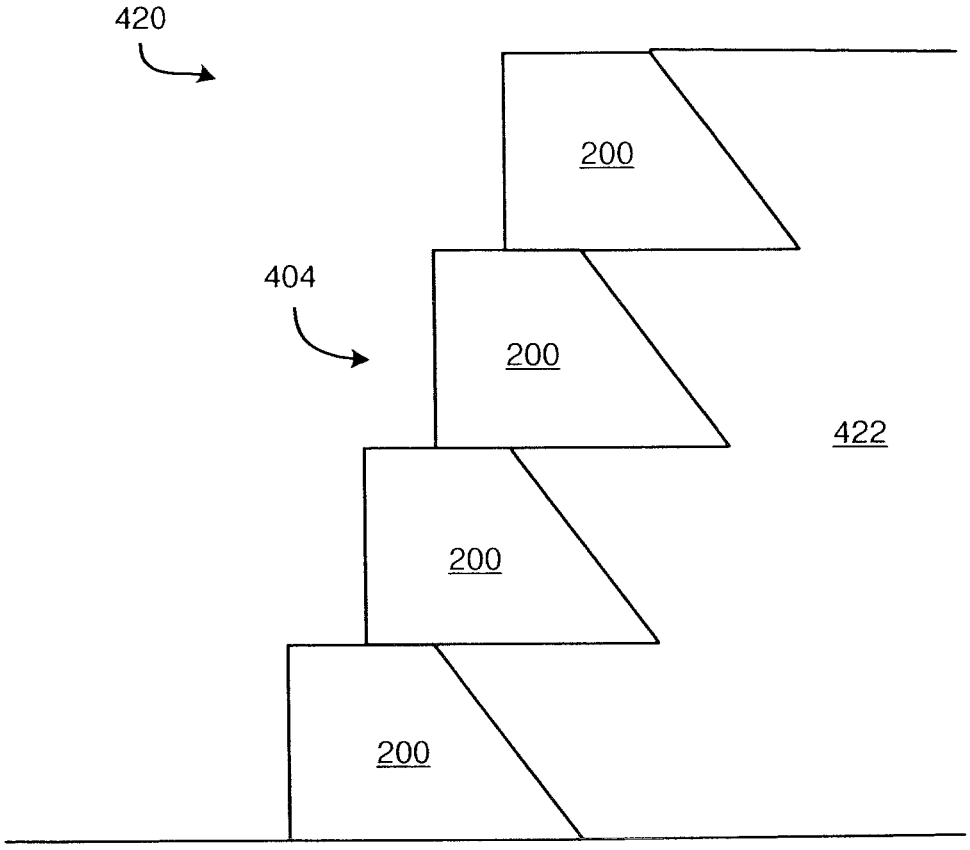

FIGS. 4A and 4B show an alternative retaining structures erected using the bag of FIG. 2A in accordance with the principles of the present invention. The retaining structures 400 and 420 depicted in these figures illustrate the versatility of the bags 200. In these structures, the substantially straight back wall is exposed and the slanted front wall is in contact with the retained material 402, 422. The exposed façade 404, 424 can then be treated with ornamental, structural (e.g., shotcrete or gunite) or preservative materials as desired.

Figure 5:
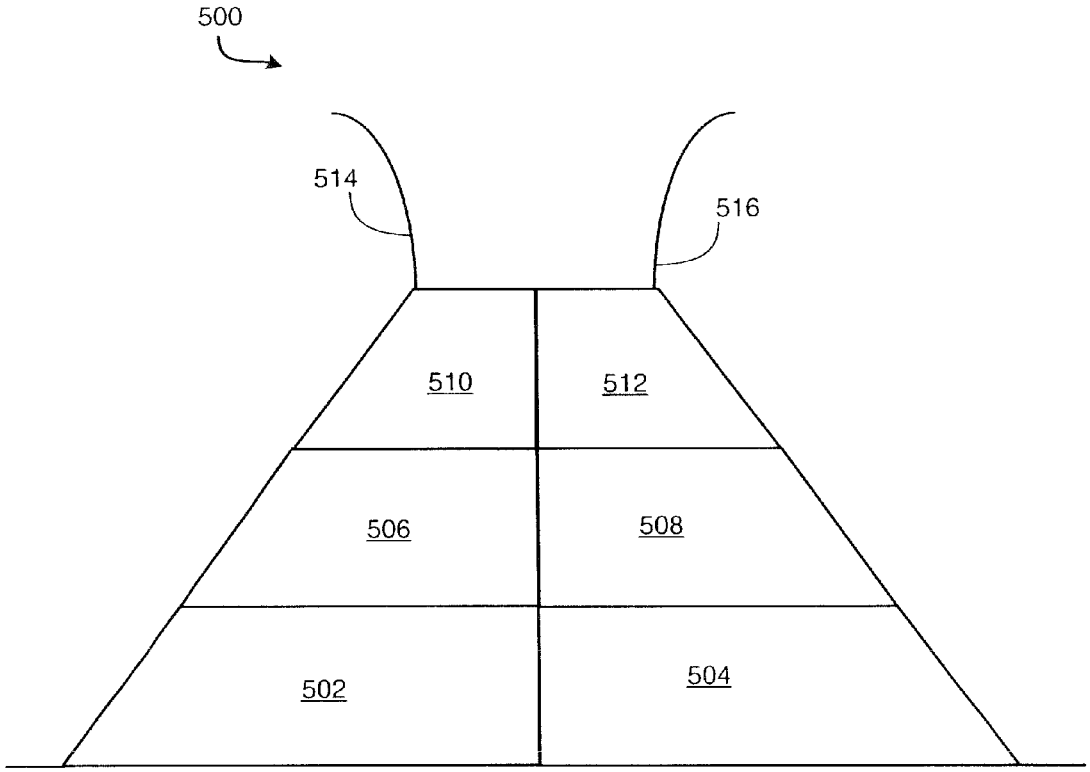
FIG. 5 shows a free standing retaining structure capable of being erected in accordance with the principles of the present invention.
Figure 6:
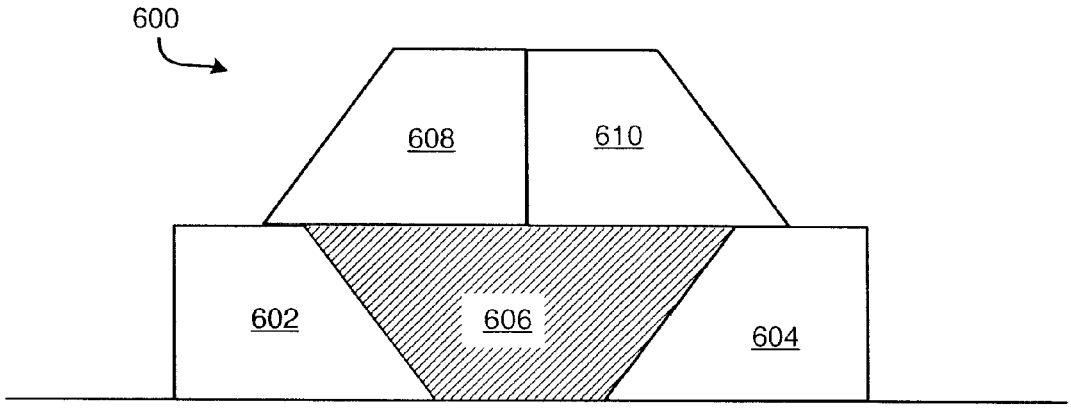
FIG. 6 shows another free standing retaining structure capable of being erected in accordance with the principles of the present invention.

FIGS. 5 and 6 illustrate the versatility and ease of use of bags constructed in accordance with the principles of the present invention. The substantially straight back wall allows construction of free-standing structures such as structure 500 that can act, for example, as a levee. Thus, structure 500 can be constructed without relying on nearby earth or material on one side for its structural strength and integrity. A bag 502 can be filled and then a corresponding back-to-back bag 504 can be filled. These two bags provide a foundation for smaller bags 506 and 508, which are filled to provide a foundation for even smaller bags 510 and 512. Although the structure 500 in FIG. 5 is depicted as symmetrical, the bags can vary in size so that the slope on one outward-facing side is different than the slope on the other outward-facing side. Top flaps 514 and 516 are shown that can be lowered once the bags 510 and 512 are filled.

Another alternative structure 600 is depicted in FIG. 6. Bags 602 and 604 can be filled and oriented so as to provide a flat outward face (although they could be flipped around as well). Then material 606 can fill in the area between the two bags 602, 604. Sand, sand bags, concrete, etc. can all be used for the material 606. On top of this base structure other bags can be placed such as bags 608 and 610. Although not shown, additional bags can continue to be stacked to make a retaining structure of a desired height.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with each claim's language, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A method of erecting a retaining structure comprising the steps of:

(a) providing a first bag collapsible in a first direction;

(b) filling at least a first cell of a first bag with a filling material;

(c) extending the length of the first bag in the first direction; and (d) filling at least a second cell of the first bag with the filling material;

(e) placing an additional bag on top of the first bag; and (f) filling the additional bag with an additional filling material;

wherein the first bag and the additional bag each comprise a plurality of cells aligned side-by-side in a continuous manner, wherein the plurality of cells of the first bag includes the first cell and the second cell, and wherein each cell of the first bag and the additional bag comprises:

a bottom wall, a first side wall, a second side wall, a back wall, and a front wall, the front wall being longer than the back wall, such that a particular angle is formed where the front wall connects with the bottom wall; and wherein the first and second side walls each include:

a first corner located where the back wall connects with the bottom wall, said first corner being substantially 90 degrees; and a second corner located where a respective top edge of each side wall connects with the back wall, said second corner being substantially 90 degrees.

2. The method of claim 1, wherein step (e) comprises placing the additional bag on top of the first bag such that the respective front walls of the first and additional bags are aligned and a face of the retaining structure is formed by the aligned front walls of the first and additional bags after the additional bag is filled in step (f), the face of the retaining structure sloping at an angle substantially the same as the particular angle.

3. The method of claim 1, wherein step (e) comprises placing the additional bag on top of the first bag such that the respective back walls of the first and additional bags are aligned and a face of the retaining structure is formed by the aligned back walls of the first and additional bags after the additional bag is filled in step (f), the face of the retaining structure being substantially vertical relative to the ground.

4. The method of claim 1, wherein each cell of the first bag further comprises:

a top wall.

5. The method of claim 4, wherein the top wall is attached to one of the back wall or the front wall along an edge of at least one cell of the first bag, and wherein the top wall is configured as a flap that is positionable in a first position to cover the at least one cell and in a second position to uncover the at least one cell.

6. The method of claim 1, wherein each cell further comprises:

a top opening between the front wall and the back wall.

7. The method of claim 1, wherein the filling material includes one or more of sand, cement, concrete or crushed rock.

* * * * *